United States Patent [19]

Salomon

[11] 4,104,811

[45] Aug. 8, 1978

[54] APPLIED TO SKI BOOTS

[75] Inventor: Georges Pierre Joseph Salomon, Annecy, France

[73] Assignee: S.A. des Etablissements Francois Salomon & Fils, Annecy, France

[21] Appl. No.: 782,304

[22] Filed: Mar. 28, 1977

[30] Foreign Application Priority Data

Apr. 1, 1976 [FR] France ..... 76 09439

[51] Int. Cl.[2] ..... A43B 5/04; A43B 11/00; A43C 11/00; A43B 21/00

[52] U.S. Cl. ..... 36/121; 36/50; 24/71 SK; 24/73 GC

[58] Field of Search ..... 36/117, 118, 119, 120, 36/121, 50; 24/68 SK, 69 SK, 70 SK, 71 SK, 73 GC, 81 SK

[56] References Cited

U.S. PATENT DOCUMENTS

| | | | |
|---|---|---|---|
| 1,489,126 | 4/1924 | Jansizian | 36/50 X |
| 2,494,701 | 1/1950 | Gogerty | 36/50 X |
| 3,263,292 | 8/1966 | Fekete | 36/50 X |
| 3,845,769 | 11/1974 | Shaw | 36/50 X |
| 3,945,135 | 3/1976 | Hanson et al. | 36/121 |
| 3,975,838 | 8/1976 | Martin | 36/121 |

*Primary Examiner*—Patrick D. Lawson
*Attorney, Agent, or Firm*—Haseltine, Lake & Waters

[57] ABSTRACT

A ski boot comprising an upper whose stiffness is adjustable and an adjustable closure element surrounding the upper. The closure element can be secured to the upper in one of a plurality of different positions for varying the stiffness and/or inclination of the upper respectively. The closure element comprises a collar positioned for cooperating with the upper at the front portion thereof, the collar being removably attached to the upper at a selected one of a plurality of positions at the lateral edge regions of the upper.

20 Claims, 15 Drawing Figures

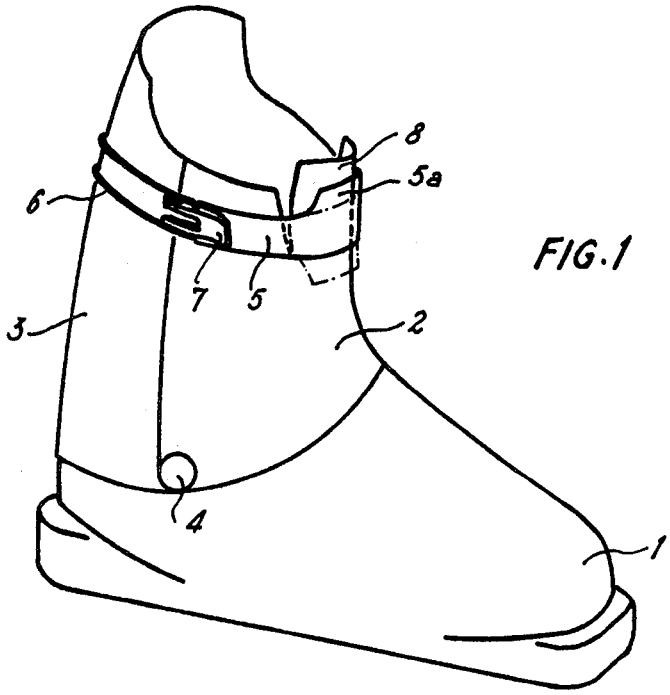
FIG. 1
FIG. 2
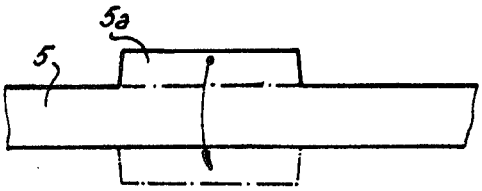
FIG. 3
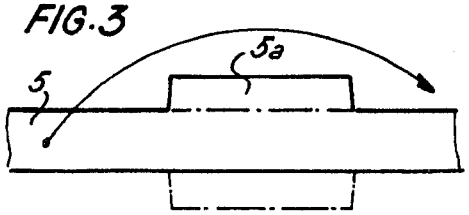
FIG. 4
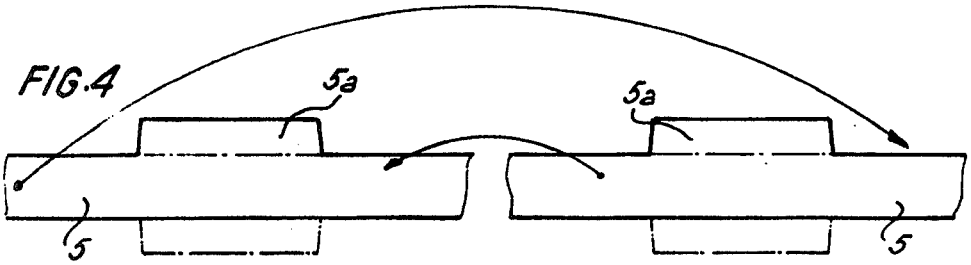
FIG. 5
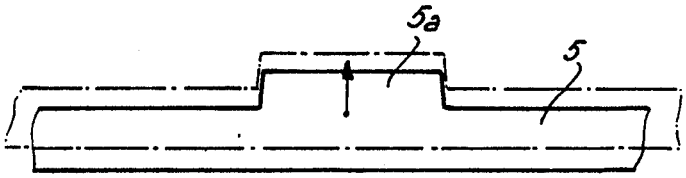

FIG. 6
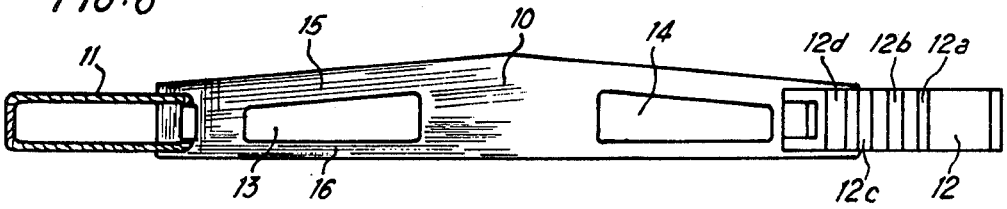
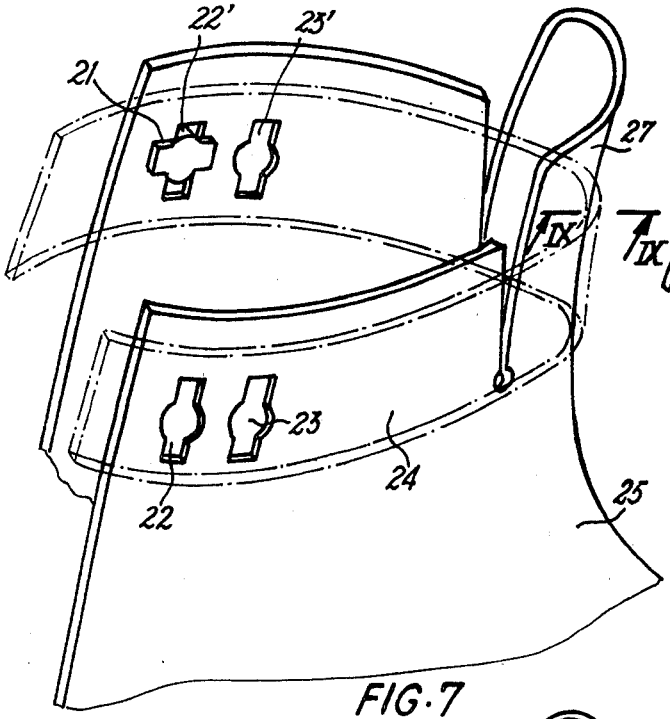
FIG. 7
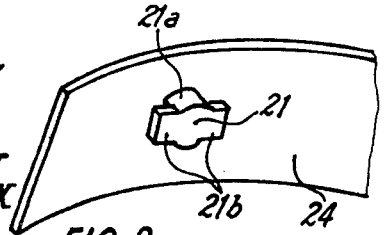
FIG. 8
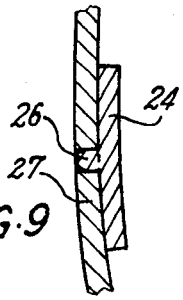
FIG. 9
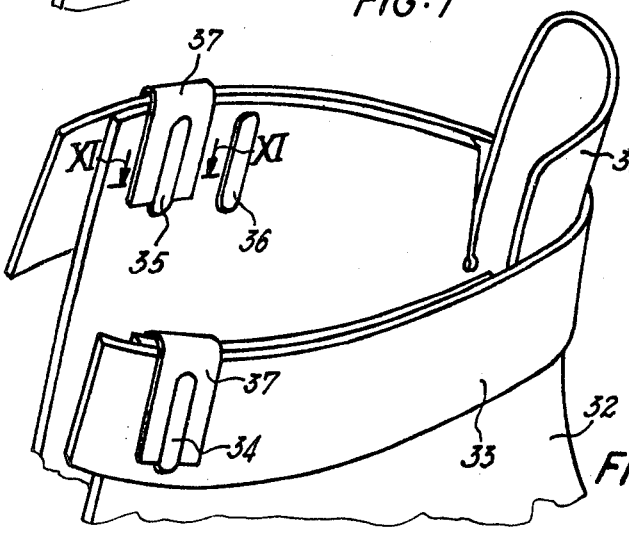
FIG. 10
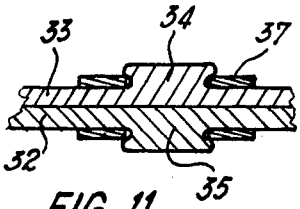
FIG. 11

APPLIED TO SKI BOOTS

The invention relates to improvements applied to ski boots.

This ski boot is of the type in which the stiffness of the upper is adjustable and comprises a collar surrounding said boot upper. It is characterised in that means are provided for securing the collar 5 in one of several different positions for varying the stiffness of the upper and/or the angle of inclination of the leg correlatively.

FIELD OF THE INVENTION

The present invention relates to improvements applied to ski boots.

PRIOR ART

It is known to provide devices for adjusting the angle of inclination of the upper of a ski boot with respect to the plane of the sole.

Systems for adjusting the rigidity of this upper with respect to the lower part of the foot are also known. In general, these are complex mechanical systems ill-suited for a ski boot.

SUMMARY OF THE INVENTION

The present invention seeks to remedy these drawbacks.

To this end, this ski boot, in which the stiffness of the upper is adjustable, comprising a collar surrounding said boot upper, is characterized in that means are provided for fixing the collar in one of several different positions for varying the stiffness of the upper and/or the angle of inclination of the leg, respectively.

The invention also contemplates to a device for adjusting the point of attachment of the buckle for tightening this collar. The various designs shown have been produced for the sake of facility of construction and use by skiers.

BRIEF DESCRIPTION OF THE DRAWINGS

Various embodiments of the present invention will be described hereafter, as non-limiting examples, with reference to the accompanying drawings in which:

FIG. 1 is a perspective view of a boot showing the principle of the invention;

FIGS. 2 to 5 are views of a collar spread out flat, illustrating various methods of obtaining variable stiffness;

FIG. 6 is a plan view of a variation of the collar;

FIG. 7 is a perspective view of one embodiment of the invention ensuring adjustment of the angle of inclination of the leg, the collar being shown in dot-dash lines.

FIG. 8 is a perspective view taken in one end of the collar;

FIG. 9 is a sectional view, on line IX—IX of FIG. 7, of the collar, in its central part;

FIG. 10 is a perspective view of a variation of the adjustment of the angle of inclination of the leg;

FIG. 11 is a sectional view, taken on line XI—XI in FIG. 10, of the device for fixing the collar to the flap;

DETAILED DESCRIPTION

Figure 12:
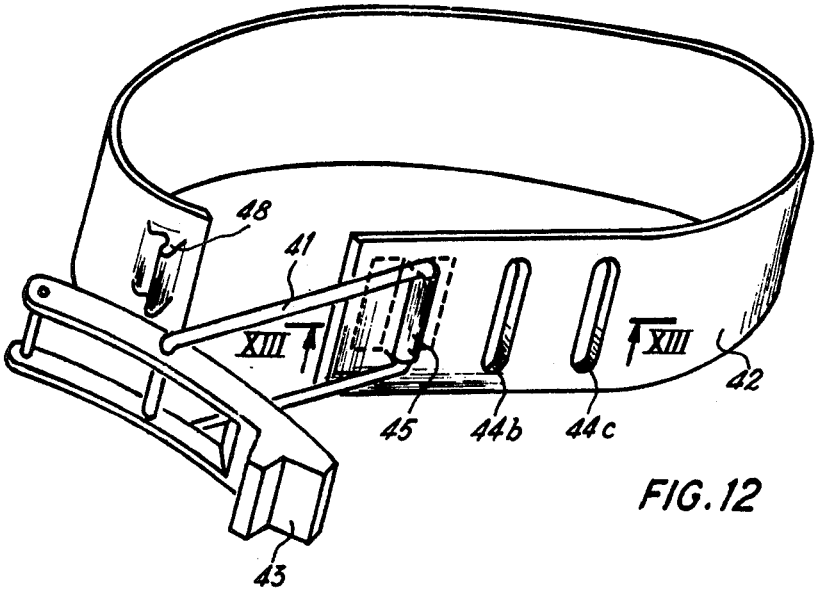
FIG. 12 is a perspective view of a device for adjustable attachment of the buckle to a collar according to the invention.
Figure 13:
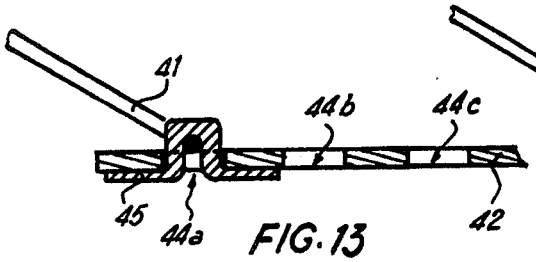
FIG. 13 is a sectional view, taken on line XIII—XIII of FIG. 12, of the securing device.

The boot illustrated in FIG. 1 is constituted by a lower part 1 and an upper formed by a flap 2 covering the front of the leg and a support 3 for the rear of the leg, this support being pivoted to the two other parts by two pivots 4 located on the two sides of the boot. The boot is opened by pivoting of the rear support 3 about the pivots 4. A collar 5 is fixed in a detachable manner to the upper part of the flap 2 and the boot is closed by a device known per se comprising a flexible buckle 6 surrounding the rear support 3 and lever 7. The lever 7 is mounted by means of a pivot on one end of the collar 5 and the flexible buckle 6 engages in notches provided at the other end of the collar by a device known per se. Preferably, the upper part of the flap 2 is split vertically on the front at one or more points, in order to facilitate bending of the leg, but this is not indispensable to the invention.

Since the flap and collar both have a certain elasticity, when the skier leans forward, the collar tends to stretch and the flap to bend, whether or not the flap is split.

Over part of its length, the removable collar 5 comprises a lateral projection **5*a*** giving the collar a greater width at this point and consequently greater transverse rigidity. This lateral projection may have a constant width, therefore a substantially rectangular or variable shape, hence a curved edge.

The removable collar 5 may be secured with its lateral projection **5*a* in the upper position (as shown in thick line in FIG. 1) or in the lower position (as shown in dot-dash lines in FIG. 1**).

Thus, a tongue 8 defined by the two vertical slits in the flap forms a front rigid support for the leg in the upper position of the projection **5*a* of the collar, owing to the fact that this projection thus supports the tongue 8 over part of its height and on the other hand it constitutes a flexible support in the lower position of the projection 5*a*, owing to the fact that the latter no longer supports the tongue 8**.

This result may be obtained in the various ways illustrated in FIGS. 2, 3, 4 and 5. In FIG. 2, the collar 5 is turned through 180°, along an axis in the plane of the collar. In this case, the collar 5 and flap 2 are provided with means making it possible to secure the collar on the flap in either of two symmetrical positions with respect to a horizontal plane parallel to the collar. In this embodiment, by turning the collar, the inner and outer sides of the collar are changed. This produces the major drawback of requiring a very special closure device operating on either side of the collar.

The collar of FIG. 3 eliminates the preceding drawback, since the stiffness of the boot upper is changed by rotation of the collar through 180° along an axis at right-angles to the plane of the collar. The right and left-hand ends of the collar are changed by rotation of the collar. It is therefore necessary to provide a buckle device of slight longitudinal bulk and to locate the latter on the rear part of the upper such that the buckle is not located on the inner side of the boot, depending on the position of the collar.

The collar of FIG. 4 prevents the two preceding drawbacks. Adjustment of the stiffness of the boot upper is obtained by rotation of the collar illustrated in FIG. 3, followed by exchange of the collars of the right-hand boot and left-hand boot. In this way, the inner end of the collar of the right-hand boot becomes the inner end of the collar of the left-hand boot. It is thus possible to provide a lever according to conventional technology on the outer side of the boot, an area where it is the most practical to use and the least troublesome when skiing.

The collar of FIG. 5 is adjusted by simple vertical displacement. In this case, the upper and the collar comprise engagement members co-operating in order to be able to fix the collar in a predetermined position from several possible positions staggered with respect to each other in the vertical direction.

It is possible to design the adjustment of the stiffness of the support in another manner. Turning of the collar may have an effect not on the upper or lower position of the projection 5*a* of the collar, i.e. on its upper edge, but on its elasticity. In fact, when the skier leans forward, the collar stretches, which facilitates bending of the tongue 8 of the flap 2. If the collar has greater resistance to traction in one position than in another, i.e. if it has inherent rigidity varying in the transverse direction, this produces different stiffness of the boot upper. FIG. 6 shows a collar of this type.

The collar 10 is provided with a quick-action fastening device respectively comprising at its two ends, a buckle 11 and a lever 12 provided with notches 12*a*, 12*b*, 12*c*, 12*d* facilitating tightening of this collar. Two elongated longitudinal apertures 13 and 14, located in the end parts of the collar (on each side of the flap when the collar is mounted on the boot), define marginal portions 15 and 16 of the collar having unequal widths and consequently unequal rigidity. When the skier leans forwards, the tongue 8 bends and is supported mainly on the upper part of the collar. It follows that if the marginal portion 15 of the collar, having the greatest width and consequently greatest rigidity, is located in the upper position, the support is more rigid than when the marginal portion 16 of smaller width is in the upper position. The collar 10 may be turned by one of the methods previously described with reference to FIGS. 2, 3 and 4.

It is also possible to provide a single elongated longitudinal opening in the central part of the collar, this opening defining two marginal portions of different widths, like those of the collar 10.

The variation of stiffness or transverse rigidity could also be obtained by a band having areas of different thickness in the transverse direction or even by areas made from different materials having different inherent rigidity.

Naturally, the variation of elasticity of the collar 10, according to the position which it occupies on the boot upper, may be used jointly with the variation of stiffness provided by the solutions illustrated previously with reference to FIGS. 1 to 5.

FIGS. 7, 8 and 9 show means for adjusting the angle of advance of the boot, i.e. the angle that the front of the skier's leg makes with respect to the plane of the sole. A collar 24 is fixed to a flap 25, constituting part of the boot upper, in one of several positions staggered with respect to each other in a horizontal plane. This fastening is achieved by means of two lugs 21, of T-shape, integral with the collar 24, close to its ends and projecting on the same side of this collar. Each of the lugs 21 comprises a cylindrical core 21*a*, extending at right-angles to the collar to which it is fixed and two sides 21*b* at right-angles to the core 21*a* and whose width is less than the diameter of this core. The two sides 21*b* of the lug 21 extend in the longitudinal direction of the collar 24. The two lugs 21 may be introduced respectively into one of two rear and front slots 22 and 23 respectively, located on the right-hand side of the flap, in its upper part and in one of two other rear and front slots 22' and 23' respectively, located on the left-hand side of the flap 25, in its upper part. These two series of slots aligned horizontally could each naturally comprise a number of slots greater than two. These various slots have the same profile as the lugs 21 seen in plan view, but they are staggered by 90°, in other words they extend in the vertical direction.

In order to be able to secure the collar 24 to the flap 25, this collar is placed in a plane at right-angles to the plane of its final position, i.e. in a vertical plane, such that the sides of the lugs 21 are arranged in a direction parallel to the slots 22, 22', 23 and 23'. The lugs 21 are then introduced into two of these slots located one on the left-hand side and the other on the right-hand side. The collar 24 is then pivoted forwards through 90° about its lugs, to bring the latter into a horizontal position as shown in FIG. 7 and finally a pin 26 provided at the front of the collar and directed towards the inside like the lugs 21, is made to penetrate a hole in the tongue 27 which is separated in the flap 25 by two lateral and vertical slots.

Thus, if the two lugs 21 are introduced into the rear slots 22 and 22', the collar 24 is located generally in a rear position and a raised position of the tongue 27 of the flap 25 is obtained. On the other hand, if the lugs 21 are introduced into the front slots 23 and 23', an advanced position of the collar 24 is obtained and consequently of the tongue 27, whereas if one of the lugs 21 is located in the rear slot 22 (or front slot 23) and the other lug 21 is located in the front slot 23' (or rear slot 22'), the tongue 27 is maintained in an intermediate position.

The "T" shape of the lugs 21 keeps the collar 24 pressed against the flap 25. The cylindrical part 21*a* of the lugs 21 retains the ends of the collar 24 vertically. The pin 26 of the collar 24 retains the latter vertically on the front of the boot upper.

Naturally, each lug 21 could comprise solely the cylindrical core 21*a* and a single side 21*b* at right-angles, the slots thus having a circular shape extended on one side by a radial notch of lesser width.

One variation would consist of providing T-shaped bosses 21 on the flap 25 and the slots 22, 22', 23, 23' on the collar 24.

FIGS. 10 and 11 show a second embodiment of adjusting the angle of inclination of the skier's leg, only the upper part of a flap 32 being shown. A collar 33 is provided on its outer side and close to each of its ends, with a projection 34 extended in the vertical direction. Likewise, the internal side of the flap 32 comprises, close to its upper and rear edges, two substantially horizontal rows of rear and front projections 35 and 36 respectively, one on the left-hand side, the other on the right-hand side. Riders 37 make it possible to make the projection 34 at one end of the collar correspond to one of the projections 35 or 36 on the corresponding end of the flap 32. Each rider 37 is constituted by a rigid U-shaped part covering the upper edge of the flap and whose two sides are recessed in order to be able to receive and trap the projections 34, 35, 36. At the front, a hole in the flap co-operates with a pin on the collar as in the preceding embodiment.

A variation of this latter embodiment would consist of providing housings on the inner side of the collar 33 (or on the outer side of the flap 32) for receiving projections on the outer side of the flap 32 (or on the inner side of the collar 33). Two U-shaped riders keep these devices connected, as in the preceding embodiment.

In the two preceding embodiments, the collars 5, 24, 33 are designed to be attached to the flaps 2, 25, 32. However, it would be possible to secure the collars to the rear supports by identical means or other means known per se.

FIGS. 12, 13, 14 and 15 show an original device for securing a closed buckle 41 to a collar 42 according to the invention. The present device makes it possible to pivot the buckle at any chosen point depending on the degree of tightening desired and the morphology of the foot, without requiring opening of the buckle. This makes it possible to produce a closed buckle, which is much easier to design than a buckle which has to open for adjusting the tension of the closure. This buckle 41 may be made from flexible cable, or a rigid material such as steel. The device may be used either for a single buckle co-operating with a lever pivoted at the other end of the collar (as illustrated in FIG. 6) or for a buckle on which a lever 43 is pivoted, co-operating with one or more notches 48 provided at the other end of the collar 42 (as shown in FIG. 12). The collar 42 is provided, in one of its end parts, with a row of oblong slots 44*a*, 44*b*, 44*c* extending in the transverse direction of the collar according to the invention. These various slots facilitate varying adjustment of the tension of the collar.

A part 45, having a cross section in the form of an omega (U extended laterally by two opposite perpendicular sides), is introduced by its central part in the form of a U into one of the slots and fulfils the function of a cotter pin as regards the buckle 41. For this, the closed buckle 41, with one of its small sides at the front, is firstly introduced partly into one of the oblong slots 44*a*, 44*b* or 44*c*. The part 45 is then placed between the buckle 41 and the collar 42 such that the other small side of the buckle is housed in the central U-shaped section of the omega shaped part. One then pulls on the buckle such that the central U-shaped section of the part 45 penetrates the chosen slot 44*a*, 44*b* or 44*c*, until its sides come to bear against the inner side of the collar. If it is desired to adjust the tension of the collar 42 differently, it is sufficient to push the part 45 as well as the buckle 41 through the slot in the collar 42 in order to withdraw the part 45 and to be able to fix the arrangement of the buckle 41 and part 45 in another slot according to the above-described process.

Figure 14:
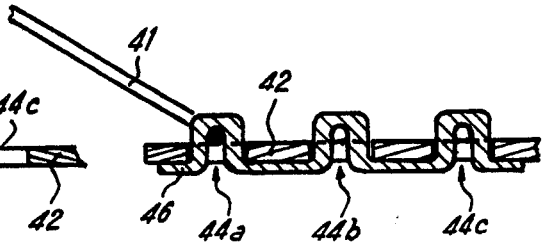
FIG. 14 is a sectional view of a first variation of the preceding device, taken on line XIII—XIII of FIG. 12.

FIG. 14 shows a variation in which a part 46 having three successive U-shaped profiles is used in place of the part 45 having a single U-shaped profile. Adjustment of the buckle 41 is achieved according to the above-described process. This variation offers the advantage of providing greater strength of the part 46.

Figure 15:
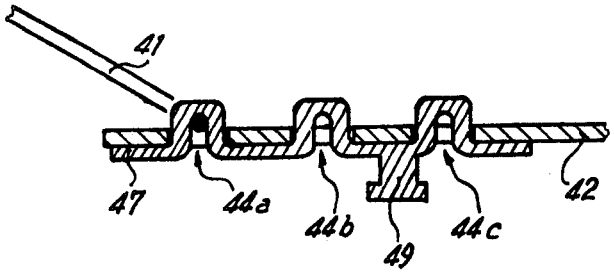
FIG. 15 is a sectional view of a second variation of the device for adjustably securing the buckle to the collar, taken on line XIII—XIII in FIG. 12.

FIG. 15 shows another variation. In addition to the three successive U-shaped profiles of the part 46, the part 47 of FIG. 15 comprises a part 49 of T-shape identical to the lug 21 of FIG. 8 and which serves for securing as well as adjusting the collar 42 on the flap. Thus, the part 47 fulfils two functions, that of securing the buckle 41 to the collar 42, on the one hand, and that of securing the collar 42 to the flap on the other hand. The parts 45, 46, 47 may be made from rigid plastic material such as "Hostaform" or from metal.

In the present description, we have considered a boot with a rear opening in three parts (a lower part 1, a flap 2 and a rear support 3 provided with a removable collar 5,) but one could have designed a boot with one or two parts, having a front or rear opening. The scope of the invention is not limited to the design proposed, but extends to any boot having a collar of which the position of the upper edge and/or whose section subject to maximum stress are variable depending on the position of the collar.

It goes without saying that the collar, which in the explanation, acts on the front part of the flap, may be used on the rear part of the boot. One may thus obtain a rear support adjustable as regards its angle and stiffness. Such a use of the invention is advantageous particularly for a boot opening at the front.

Similarly, the collar could be used on one of the sides of the boot in order to modify the angle of lateral inclination of the boot upper.

I claim:

1. A ski boot comprising an upper whose stiffness is adjustable, an adjustable closure element surrounding said upper, and means for securing said closure element to said upper in one of a plurality of different positions for varying the stiffness and/or inclination of the upper respectively, said upper having a front portion with lateral edge regions, said closure element comprising a collar positioned for cooperating with said upper at the front portion thereof, said means for securing the closure element comprising means for removably attaching the collar to the upper at a selected one of a plurality of positions at said lateral edge regions.

2. A ski boot as claimed in claim 1 wherein the means for securing the closure element to the upper comprises means for permitting adjustment of the relative position of the closure element in a vertical direction.

3. A ski boot as claimed in claim 1 wherein the means for securing the closure element to the upper comprises means for securing the closure element in symmetrically interchangeable positions relative to the longitudinal axis of the closure element.

4. A ski boot as claimed in claim 1 wherein the means for securing the closure element to the upper comprises means for securing the closure element in symmetrically interchangeable positions relative to the transverse axis of the closure element.

5. A ski boot as claimed in claim 1 wherein the means for securing the closure element is so provided on each booth of a pair of ski-boots so that the collar from one boot can be mounted on the other boot and vice-versa.

6. A ski boot as claimed in claim 1 wherein said collar has a central part and includes a lateral projection at said central part of constant width capable of being located at different heights according to the position at which the collar is secured to the upper.

7. A ski boot as claimed in claim 1 wherein said collar has a central part and includes a lateral projection at said central part of variable width capable of being located at different heights according to the position at which the collar is secured to the upper.

8. A ski boot as claimed in claim 1 wherein said collar has inherent rigidity varying in the transverse direction.

9. A ski boot as claimed in claim 8 wherein said collar has at least one aperture elongated in the longitudinal direction defining opposite marginal portions.

10. A ski boot as claimed in claim 9 wherein said marginal portions have different widths providing different rigidity.

11. A ski boot as claimed in claim 10 wherein said marginal portions have different thickness of material providing different rigidity.

12. A ski boot as claimed in claim 11 wherein said marginal portions have different materials providing different rigidity.

13. A ski boot as claimed in claim 1 wherein said plurality of positions at which said means attaches the collar to said upper are staggered with respect to each other in a horizontal plane.

14. A ski boot as claimed in claim 13 wherein said means for attaching the collar to said upper comprises two lugs projecting on the same side of the collar at each end thereof, each lug comprising a cylindrical core extending at right-angles to the collar and at least one side at right-angles to the core, said side having a width less than the diameter of the core, said upper being provided at said lateral edge regions with two series of slots of the same profile as that of the lugs, but turned by 90° to facilitate introduction of the lugs into the slots with the collar in the vertical position and to ensure locking of the collar on the upper by rotation of the collar and lugs through 90° into the horizontal position.

15. A ski boot as claimed in claim 1 wherein said means for attaching the collar to said upper comprises at least one vertical projection on the outer surface of said collar at each of the ends thereof, said upper having an upper portion, and at least one further projection at said upper portion of the upper on the inner surface thereof and removable riders for selectively engaging over the upper edge of the collar and upper for interconnecting said projections.

16. A ski boot as claimed in claim 15 wherein said riders are of U-shape.

17. A ski boot as claimed in claim 1 wherein said collar includes a pin facing inwardly, said upper including a tongue located in an upper portion of the upper and defined by two vertical lateral slots in said upper, said tongue having a hole receiving said pin.

18. A ski boot comprising an upper and a collar surrounding said upper, said collar comprising a closed pivoted buckle co-operating with a lever for closing the collar, said collar having an end provided with a row of oblong slots extending in the transverse direction of the collar, and a support member comprising a U-shaped part engageable in one of said slots, said buckle including a side link traversing said U-shaped part and constituting a pivot connection for the buckle to the collar, said U-shaped part including two lateral sides bearing on the inner surface of the collar on either of the oblong slot in which the U-shaped part is engaged.

19. A ski boot as claimed in claim 18 wherein said support member comprises a plurality of successive U-shaped parts connected to one another and respectively engaged in said oblong slots.

20. A ski boot as claimed in claim 19 wherein said support member comprises lug means on the inner surface of the collar for securing the collar to the boot upper.

* * * * *